US005921665A

United States Patent [19]

Malik

[11] Patent Number: 5,921,665

[45] Date of Patent: Jul. 13, 1999

[54] PROJECTION ILLUMINATION SYSTEM FOR TRICOLOR PROJECTORS

[75] Inventor: Amjad I. Malik, Vancouver, Wash.

[73] Assignee: Delta America Ltd., Fremont, Calif.

[21] Appl. No.: 08/766,893

[22] Filed: Dec. 13, 1996

[51] Int. Cl.[6] ..... F21V 13/04

[52] U.S. Cl. ..... 362/338; 362/328

[58] Field of Search ..... 362/328, 338, 362/241, 72, 307, 473

[56] References Cited

U.S. PATENT DOCUMENTS

| | | | |
|---|---|---|---|
| 4,345,303 | 8/1982 | Gerard et al. | 362/328 |
| 4,383,290 | 5/1983 | Binder et al. | 362/328 |
| 4,538,216 | 8/1985 | Mori et al. | 362/328 |
| 4,755,921 | 7/1988 | Nelson | 362/307 |
| 4,803,608 | 2/1989 | Dashwood | 362/72 |
| 4,974,178 | 11/1990 | Izeki et al. . | |
| 5,179,658 | 1/1993 | Izawa et al. . | |
| 5,224,085 | 6/1993 | Shinkai et al. . | |
| 5,404,437 | 4/1995 | Nguyen . | |
| 5,440,456 | 8/1995 | Bertling et al. | 362/328 |
| 5,448,551 | 9/1995 | Miyagawa et al. . | |
| 5,504,544 | 4/1996 | Dreyer et al. | 362/241 |
| 5,613,769 | 3/1997 | Parkyn, Jr. et al. | 362/338 |
| 5,664,141 | 9/1997 | Yamamuro . | |
| 5,671,202 | 9/1997 | Brownstein et al. . | |

OTHER PUBLICATIONS

TIR Technologies, Inc. Advertisement.

*Primary Examiner*—Laura Tso

*Attorney, Agent, or Firm*—Skjerven, Morrill, MacPherson, Franklin & Friel LLP; David W. Heid

[57] ABSTRACT

A projection illumination system which includes a source light with a projection axis passing generally centrally through this light, and dual-side light-gathering structure, including a reflector and a TIR lens structure generally embracing the source light on opposite sides thereof and along the projection axis, with this light-gathering structure being capable of directing, ultimately outwardly from the source light and unidirectionally along the projection axis, a major percentage of light generated by the source light.

6 Claims, 1 Drawing Sheet

PROJECTION ILLUMINATION SYSTEM FOR TRICOLOR PROJECTORS

BACKGROUND AND SUMMARY OF THE INVENTION

This invention relates to a projection illumination system and apparatus therein, and more particularly to a system employable for tricolor projection, wherein, for a given light source energy level, a much higher percentage, and therefore higher intensity, of light emanates from the system than is possible with prior known projection systems. A preferred embodiment of the invention is described herein in the setting of tricolor video projection—an environment wherein the invention has been found to offer particular utility.

In the field of this invention, a consideration which looms as an ever present, significant hurdle and challenge relates to the obtaining of maximum intensity output for a given size or power level of source light. An important objective toward which prior art developments have aimed has been to produce a light projection system which can create on, for example, a projection screen at a "reasonable distance" from the projection structure, a brilliant, high-light-intensity image which can be viewed easily even in fairly bright ambiently illuminated space.

A key object of the present invention is to provide a projection system which takes a handsome advance toward achieving this objective by providing an organization of light source and optical elements, or components, which, for a given size of source light, can achieve significantly more output light than is attainable by the best known prior art competitive projection structures.

In a typical projection system, a source light is positioned at the focal point of a parabolic mirror located on one side of the light source and "aimed" on the system's projection axis. Such a "one-side-gathering" mirror gathers, at most, about 50% of the total light produced by the source, and, because of expected and unavoidable reflection losses, reflects only about 90% of this gathered light toward the usual optically "downstream" lens. The lens in such an arrangement ususally does not play any significant role in light-gathering directly from the source light.

By way of sharp contrast, and according to a preferred embodiment of the present invention, the same, at its core, is based upon a dual-side light-gathering arrangement which is very effective, and which includes, fundamentally, three coacting elements: (a) a selected, high-intensity source light: (b) a total internal reflection (TIR) lens structure: and (c) a reflector disposed in the system on the opposite side of the light source in relation to the TIR lens structure. The light source is spaced in close physical relation to the TIR lens structure in a fashion whereby one, fairly larger-percentage portion of output light from the source directly impinges a light-gathering surface expanse in the lens structure, with the reflector (preferably one having spherical curvature) gathering another, fairly large-percentage portion of light from the source, and redirecting this light also toward the same light-gathering surface expanse in the lens structure.

With the arrangement of the system proposed according to this invention operating, a major percentage (more than 50%) of the light which is radiated by the light source is directed toward the TIR lens structure for outputting from the system. Experience has shown that the organization proposed by this invention, for a given size or power level of source light, is capable of outputting up to about 50% more light than that which can be output utilizing the best known prior art type systems.

Yet another object of this invention is to provide a projection system of the type just generally outlined which is very simple in construction, relatively low in cost, and easily employed in a wide variety of light-projection structures and settings.

These and other objects and advantages which are attained by the present invention will become more fully apparent as the description which now follows is read in conjunction with the accompanying drawings.

DETAILED DESCRIPTION OF THE INVENTION

Figure 1:
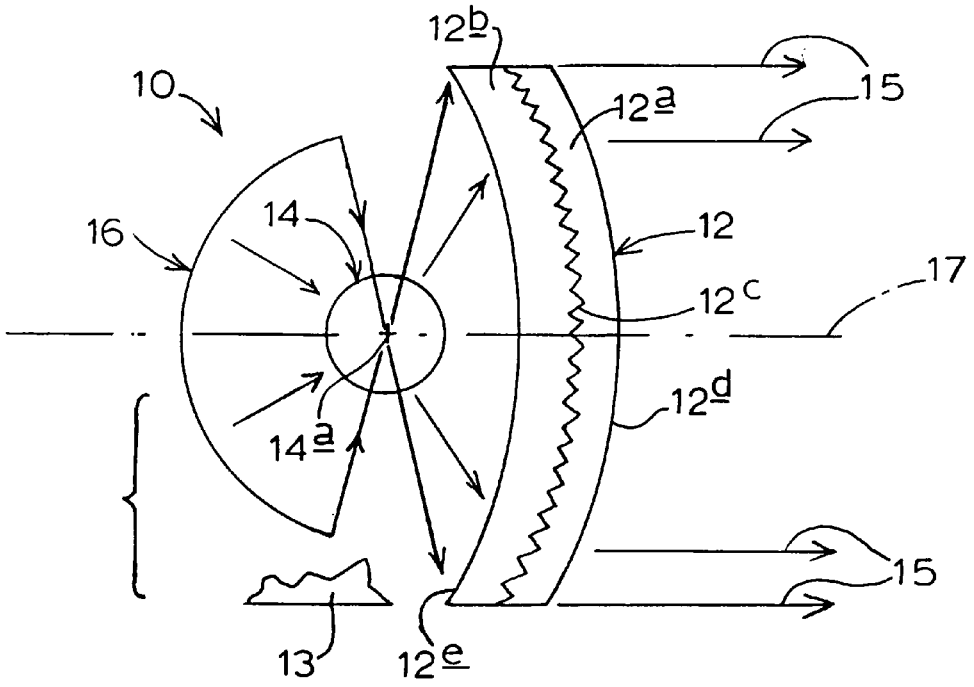
FIG. 1 is a schematic side illustration picturing a preferred form of the present invention.

Turning attention first of all to FIG. 1, indicated generally at 10 is a high-intensity optical projection system, also referred to herein as an illumination system, which, fundamentally, takes the form of a combination of three cooperating/co-acting components including a TIR lens structure 12, a high-intensity, omniderectionally radiating lamp 14, also referred to as a source light, and a reflector 16. These components herein are arranged in the setting and environment of a tricolor projector, a portion of whose frame is shown fragmentarily at 13.

Structure 12 is, essentially, a two-element assembled structure, including elements 12*a*, 12*b* which, in accordance with conventional and commercially available technology, may, for example, be a TIR lens made commercially by a company called TIR Technologies, Inc. in Hawthorne, Calif.

While lens structure 12 is conventional, several things about it will be mentioned herein. As can be seen, components 12*a*, 12*b* are generally curvilinear in nature, and are assembled along a curved, faceted interface 12*c* which plays a significant role in the total internal reflective performance of the lens. The right-hand face of structure 12, shown at 12*d*, has generally spherical curvature, and is referred to herein as an output facial expanse in the structure. The left-hand face of the lens structure, shown at 12*e*, is also referred to herein as a light-gathering surface expanse, and this face also has generally spherical curvature.

Structure 12 performs in such a fashion that light which strikes face 12*e* passes through and is "processed within" the lens in such a manner that, ideally, output light emanates from face 12*d* in a collimated fashion, directed uniformly to the right in FIG. 1 (see arrows 15). In the particular embodiment now being described, lens structure 12 takes the form of a body of revolution which is symmetrical about a axis of revolution which, as viewed in FIG. 1, is horizontal and contained within the plane of this figure. The specific design of this lens, including its chosen facial radii and the internal faceting interface, is based upon design parameters well within the skill of those skilled in the art.

Lamp 14 herein has a bulb with a diameter of about 10- to about 11-millimeters, is a metal halide type lamp, and has a power output of around 250-watts. The lamp includes what is referred to herein as an optical center which is shown generally at 14*a*. The right side of the bulb in lamp 14, the side which is nearest to face 12*e*, is spaced therefrom by a distance of no more than about ¼- inches.

Reflector 16 preferably is nearly hemispherical in configuration, and is positioned with its center of curvature substantially coincident with optical center 14*a*.

With energizing of lamp 14, a first portion of the light output from the lamp directly strikes facial expanse 12*e* and is gathered thereby for transmission through the lens structure. A large portion of the remainder of light output from lamp 14, referred to herein as a second portion of such light output, directly strikes the interior reflective surface of reflector 16, from which it is reflected back generally through optical center 14*a* also to strike and be gathered by facial expanse 12*e*. Because of this arrangement, a very high percentage, and very clearly a majority, of the light output from the lamp is directed through lens structure 12. As a consequence, for any given source lamp in such a setting, the system gathers, and transmits for projection operation, an extremely high percentage of light made available by the source light, and specifically up to about 50% more of such than that which is gathered and transmitted in known conventional projection systems.

The organization pictured in FIG. 1 is especially efficient because of the way in which facial expanse 12*e* and the inside reflective surface of reflector 16 substantially completely surround lamp 14. A way of viewing this arrangement is that lamp 14 is "embraced" on dual, opposite sides along a source, or system, projection axis 17 which lies in the plane of FIG. 1, and which is coincident with the previously mentioned axis of revolution of structure 12. Axis 17 passes through optical center 14*a*.

Figure 2:
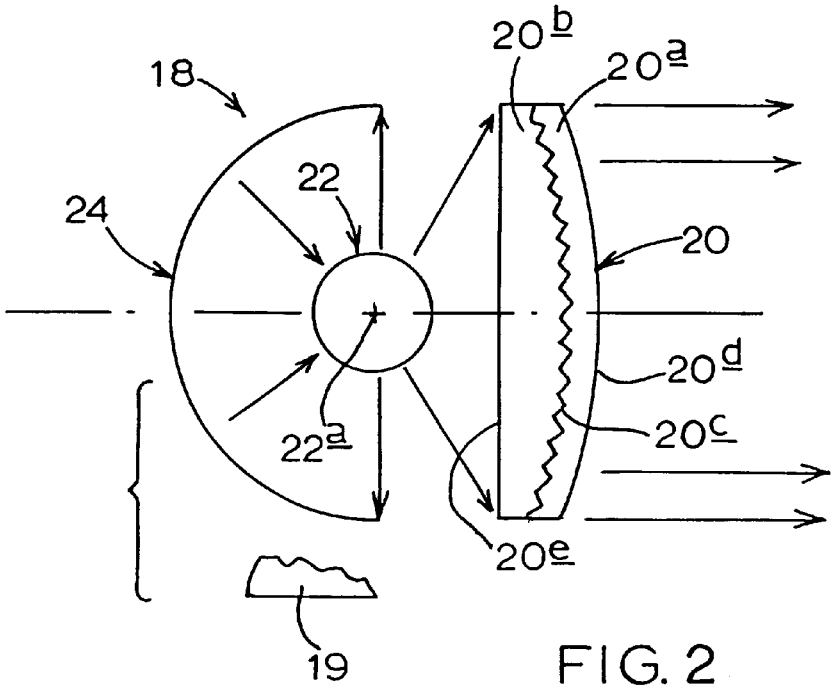
FIG. 2 is a view similar to FIG. 1 showing a modified form of the invention.

Turning attention now to FIG. 2, here there is shown a modified system 18 which includes another style of TIR lens structure 20, a lamp 22 which is the same as previously mentioned lamp 14, and a reflector 24 which is substantially the same as previously mentioned reflector 16. The frame of the tricolor projector in which system 18 "resides" is pictured fragmentarily at 19.

Structure 20, also a body of revolution, is assembled with two elements 20*a*, 20*b* which join along a faceted, curvilinear interface 20*c*. This structure has a right face 20*d* having generally spherical curvature, with this face functioning as previously mentioned face 12*d* in lens structure 12. Structure 20 has an opposite, left face 20*e* which acts as a light-gathering surface expanse such as does face 12*e* previously mentioned. Face 20*e* is substantially planar.

Lamp 22, which has an optical center 22*a*, is positioned closely adjacent face 20*e*, and herein at a distance of no more than about ¼- inches.

Reflector 24 has the same relationship to lamp 22 physically as does previously mentioned reflector 16 with respect lamp 14. Namely, the center of curvature of reflector 24 is substantially coincident with optical center 22*a*.

In general terms, the system illustrated in FIG. 2 performs in a manner which is very much like that which characterizes the performance of the system of FIG. 1, except that it somewhat less efficiently gathers light from lamp 22. Nevertheless, this system offers performance which significantly excels in relation to the performance of known prior art projection systems.

The novel system thus proposed by the present invention deals very effectively with offering a significant advance in the "from-source" percentage of light which is effectively gathered for projection through the system. As has been mentioned, for a given source light power level, the present system has been found to be capable of delivering effectively about 50% more light, and therefore significantly more illumination intensity, than is deliverable by the best known prior art systems.

Featuring as is does dual-side light-gathering structure and capability, which structure generally embraces the light source on opposite sides of that source and along the system's projection axis, enhanced illumination projection capability described herein is readily attained in a very simple, relatively low cost system which can easily be implemented in a wide variety of projection platforms.

Accordingly, while a preferred embodiment, and one modification, of the invention have been described herein, it is appreciated that other variations and modifications may be made without departing from the spirit of the invention.

It is desired to claim and secure by Letters Patent:

1. A projection illumination system having a projection axis, said system comprising a source light operable for the substantially omnidirectional radiation of light, and having an optical center located on said projection axis, a TIR lens structure spaced from, and located on one side of said source light and having a light-gathering surface expanse intersecting and spanning said axis, said surface expanse operating in the system to gather directly a first portion of light from the source, which first portion directly impinges said surface expanse, and a spherical reflector spaced from and located on the opposite side of said source light from said lens structure, said reflector intersecting and spanning said projection axis and positioned with a nominal focus approximately coinciding with the optical center of said source light, said reflector operable in the system to reflect and to redirect toward said surface expanse a second portion of light produced by said source light, said first and second portions collectively representing greater than fifty percent (50%) of light radiated from said source light.

2. The system of claim 1, wherein said light-gathering surface expanse is defined by generally spherical curvature.

3. The system of claim 1, wherein said light-gathering surface expanse is substantially planar.

4. The system of claim 1, wherein said TIR lens structure includes a light output surface expanse from which light generated in the system emanates in a collimated condition.

5. The system of claim 2, wherein said TIR lens structure includes a light output surface expanse from which light generated in the system emanates in a collimated condition.

6. The system of claim 3, wherein said TIR lens structure includes a light output surface expanse from which light generated in the system emanates in a collimated condition.

* * * * *